United States Patent [19]

Peck

[11] Patent Number: 4,525,772

[45] Date of Patent: Jun. 25, 1985

[54] VEHICLE LAMP ASSEMBLY

[75] Inventor: Anthony F. Peck, Kenilworth, England

[73] Assignee: Britax Vega Limited, England

[21] Appl. No.: 616,390

[22] Filed: Jun. 1, 1984

[30] Foreign Application Priority Data

Jun. 7, 1983 [GB] United Kingdom ..... 8315518

[51] Int. Cl.[3] ..... F21V 11/06

[52] U.S. Cl. ..... 362/290; 362/293; 362/329; 362/331; 362/333; 362/342

[58] Field of Search ..... 362/290, 293, 342, 329, 362/331, 333

[56] References Cited

U.S. PATENT DOCUMENTS

| | | | |
|---|---|---|---|
| 3,302,016 | 1/1967 | Larraburu | 362/268 |
| 3,919,543 | 11/1975 | Noren | 362/290 X |
| 4,047,020 | 9/1977 | Noren | 362/293 X |
| 4,241,388 | 12/1980 | Green | 362/293 X |
| 4,383,290 | 5/1983 | Binder et al. | 362/290 |

FOREIGN PATENT DOCUMENTS

| | | | |
|---|---|---|---|
| 2813835 | 4/1979 | Fed. Rep. of Germany | 362/290 |

*Primary Examiner*—Peter A. Nelson

*Attorney, Agent, or Firm*—Hayes, Davis & Soloway

[57] ABSTRACT

A vehicle lamp assembly has a light source, a light transmitting member, baffle elements of light absorbing material extending perpendicular to the surface of the light transmitting member towards the light source and lens means located between the baffle elements and the light source so as to concentrate light from the light source between adjacent baffle elements. The ends of the baffle elements abutting the light transmitting member are of a color chosen in accordance with the required appearance of the lamp assembly when the light source is not illuminated and the rest of the baffle elements are black.

9 Claims, 2 Drawing Figures

VEHICLE LAMP ASSEMBLY

This invention relates to vehicle lamp assemblies of the type in which the color of the light to be produced by the lamp cannot readily be perceived when the lamp is not illuminated. Patent Specification No. EP-A-0074726 discloses a lamp assembly of this type comprising a light source, a light transmitting member carrying a plurality of strips formed of light absorbing material, baffle elements of light absorbing material extending perpendicular to the surface of the light transmitting member towards the light source with each baffle element aligned with a respective one of the parallel strips, lens means arranged to concentrate light from the light source between adjacent strips and a color filter located between the light source and the baffle elements. The present invention is concerned with an improvement in or modification to a vehicle lamp assembly of this type.

According to the invention, a vehicle lamp assembly comprises a light source, a light transmitting member, baffle elements of light absorbing material extending perpendicular to the surface of the light transmitting member towards the light source, lens means located between the baffle elements and the light source and arranged to concentrate light from the light source between adjacent baffle elements, the ends of the baffle elements abutting the light transmitting member being of a color chosen in accordance with the required appearance of the lamp assembly when the light source is not illuminated and the rest of the baffle elements being black.

A color filter may be disposed between the baffle elements and the light source so as to produce illumination of the required color when the light source is illuminated. Such a colour filter can conveniently incorporate the lens means.

In one form of the invention, at least one substantially opaque strip is disposed between each adjacent pair of baffle elements, the lens means being arranged to focus light from the light source through the gaps between each strip and its adjacent baffle elements and on to the gaps between adjacent strips when more than one strip is disposed between each pair of baffle elements. At least the surface of each such strip abutting the light transmitting element is of the same color as the corresponding ends of the baffle elements. The strips may be uniformly colored. Alternatively the surfaces thereof facing away from the light transmitting member may be black.

Figure 1:
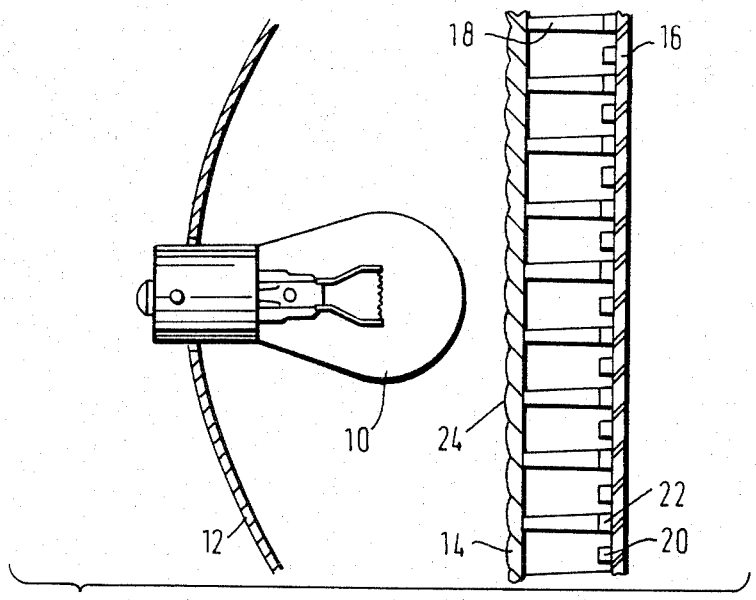
Figure 2:
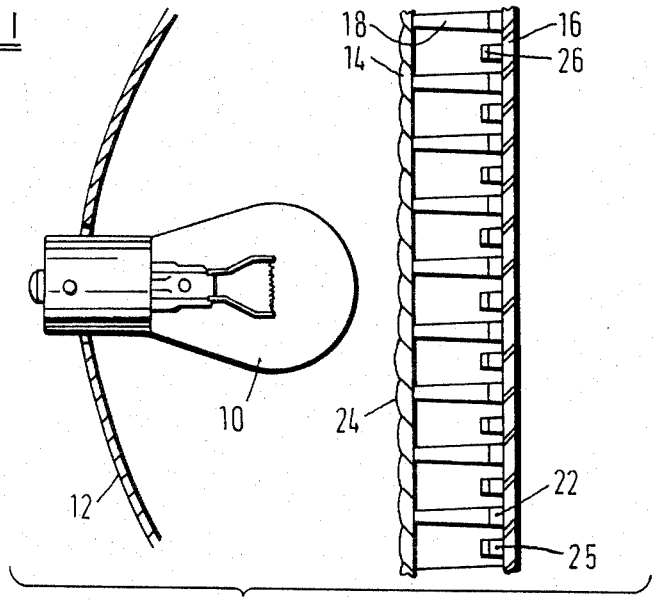

Two embodiments of the invention will now be described, by way of example, with reference to the accompanying drawings in which:

FIG. 1 is a schematic cross-sectional view of a first embodiment of the invention; and FIG. 2 is a schematic cross-sectional view of a second embodiment of the invention.

The lamp shown in FIG. 1 comprises a bulb 10, the light from which is collimated by a parabolic reflector 12 so that a parallel beam is incident on a color filter 14, the colour of which is chosen in accordance with the required color of the emitted light.

Parallel with the filter 14 is a light transmitting member 16 of transparent material which may but need not necessarily be the outer cover of the lamp assembly. A set of uniformly spaced parallel baffles 18 extend between the filter 14 and the light transmitting member 16 and the latter also carries a respective strip 20 between each pair of adjacent baffles 18. The strips 20 are of width substantially equal to the thickness of each of the baffles 18 and the strips 20 and baffles 18 are uniformly spaced so as to leave gaps of equal width between each baffle 18 and each of its adjacent strips 20. The strips 20 and the front ends 22 of each of the baffles 18 are made of a material colored in accordance with the required appearance of the lamp assembly when the bulb 12 is off while the rest of each of the baffles 18 is black. The color filter 14 incorporates lens formations 24 on at least one surface, arranged to focus the collimated light from the reflector 12 on to the gaps between the baffles 18 and the strips 20.

For example, when the invention is applied to the rear lamp assembly of a motor vehicle, the strips 20 and the front ends 22 of the baffles 18 may be colored red while the filter 14 is red, amber or colorless in dependance on the required function. The complete lamp cluster then presents a uniform red appearance when the bulbs are off, while the direction indicators and reversing lamps show amber and white respectively when illuminated. Alternatively, the strips 20 and front ends 22 of the baffles 18 may be of another colour conforming to or toning with the body colour of the vehicle.

If the material of which the strips 20 are formed is not sufficiently opaque, sufficient light from the bulb 10 may be transmitted therethrough to enable their colour to affect the perceived color of the lamp assembly when the bulb 10 is illuminated. Referring to FIG. 2, in which components identical with the corresponding components of FIG. 1 are denoted by the same reference numerals, the strips 20 are replaced by strips 25, the main part of which is of the same color as the front ends of the baffles 18. On their ends further from the light transmitting member 16, the strips 25 are capped by black portions 25 which prevent transmission of light therethrough.

I claim:

1. A vehicle lamp assembly comprising a light source, a light transmitting member, baffle elements of light absorbing material extending perpendicular to the surface of the light transmitting member towards the light source, lens means located between the baffle elements and the light source and arranged to concentrate light from the light source between adjacent baffle elements, the ends of the baffle elements abutting the light transmitting member being of a non-neutral color chosen in accordance with the required appearance of the lamp assembly when the light source is not illuminated and the rest of the baffle elements are black.

2. A vehicle lamp assembly according to claim 1, wherein a color filter is disposed between the baffle elements and the light source.

3. A vehicle lamp assembly according to claim 2, wherein the color filter incorporates the lens means.

4. A vehicle lamp assembly comprising a light source, a light transmitting member, baffle elements of light absorbing material extending perpendicular to the surface of the light transmitting member towards the light source, a respective substantially opaque strip disposed between each adjacent pair of baffle elements, lens means located between the baffle elements and the light source and arranged to concentrate light from the light source through the gaps between each strip and its adjacent baffle elements, the ends of the baffle elements abutting the light transmitting member and at least the surface of each strip abutting the light transmitting element being of a color chosen in accordance with the required appearance of the lamp assembly when the light source is not illuminated and the rest of the baffle elements being black.

5. A vehicle lamp assembly according to claim 4, wherein the surfaces of the strips facing away from the transmitting member are black.

6. A vehicle lamp assembly according to claim 5, wherein a color filter is disposed between the baffle elements and the light source.

7. A vehicle lamp assembly according to claim 6, wherein the color filter incorporates the lens means.

8. A vehicle lamp assembly according to claim 4, wherein a color filter is disposed between the baffle elements and the light source.

9. A vehicle lamp assembly according to claim 8, wherein the color filter incorporates the lens means.

* * * * *